United States Patent [19]

Pickard

[11] 4,066,493

[45] Jan. 3, 1978

[54] TREATING CELLULOSIC MATERIALS

[75] Inventor: Keith John Pickard, Widnes, England

[73] Assignee: Laporte Industries Limited, Luton, England

[21] Appl. No.: 696,183

[22] Filed: June 15, 1976

[30] Foreign Application Priority Data

June 20, 1975 United Kingdom ..... 26292/75

[51] Int. Cl.[2] ..... D21D 3/00

[52] U.S. Cl. ..... 162/158; 8/115.6; 8/181; 8/189; 106/199; 106/243; 162/179; 260/326 A; 536/30; 536/31

[58] Field of Search ..... 162/158 R, 158 N, 179; 252/182; 106/243, 199; 8/115.6, 181, 189; 260/326 A, 29.6 H; 536/30, 31

[56] References Cited

U.S. PATENT DOCUMENTS

| | | | |
|---|---|---|---|
| 2,594,145 | 4/1952 | Flory | 536/31 |
| 2,996,497 | 8/1961 | Tovey et al. | 536/31 |
| 3,008,868 | 11/1961 | Fegley et al. | 162/179 |
| 3,900,335 | 8/1975 | Beck | 162/158 |
| 3,993,640 | 11/1976 | Pickard et al. | 162/158 |

FOREIGN PATENT DOCUMENTS

| | | | |
|---|---|---|---|
| 804,504 | 11/1958 | United Kingdom | 162/158 |

*Primary Examiner*—S. Leon Bashore
*Assistant Examiner*—Peter Chin
*Attorney, Agent, or Firm*—Larson, Taylor and Hinds

[57] ABSTRACT

The present invention provides compositions for treating cellulosic materials, and in particular for sizing paper or waterproofing textiles containing as active ingredient a cyclic imide N-substituted by an hydrophobic acyl group and at least 10% by weight based on the cyclic imide of an aliphatic acid. Preferred acids contain from 14 to 26 carbon atoms and are preferably saturated monobasic acids. Preferably the compositions contain from 25 to 125% by weight of aliphatic acid based on the cyclic imide. The compositions are suitable for sizing aqueous paper pulp, and especially bleached sulphate pulp.

8 Claims, No Drawings

TREATING CELLULOSIC MATERIALS

The present invention relates to improvements in or modifications to compositions and processes for treating cellulosic materials.

In copending U.S. patent application Ser. No. 530,964 (now U.S. Pat. No. 3,993,640) and its equivalent application in Germany No. P2460262.8, which was published on July 3, 1975 in the name of Laporte Industries Limited, there are described compositions for treating cellulosic materials, and in particular for sizing paper or waterproofing textiles, in which the reactive agent is a cyclic imide N-substituted by an hydrophobic acyl group. In an improvement in or modification to such compositions, it has now been discovered that the addition of certain aliphatic acids can result in more effective utilization of the cyclic imide, i.e., extension.

According to the present invention there is provided a composition for treating cellulosic materials comprising a dispersion of (a) cyclic imide N-substituted by an hydrophobic acyl group, and (b) at least 10% by weight, based on the substituted cyclic imide, of an aliphatic acid having an hydrophobic moiety comprising a straight chain having an effective length of at least 6 carbon atoms, or a precursor which generates the aliphatic acid in use.

According to a second aspect of the present invention there is provided a process for treating cellulosic materials comprising the steps of contacting the cellulosic material with a composition comprising a dispersion of (a) a cyclic imide N-substituted by an hydrophobic acyl group and (b) at least 10% by weight based on the substituted cyclic imide, of an aliphatic acid having a hydrophobic moiety comprising a straight chain having an effective length of at least 6 carbon atoms, or a precursor which generates the aliphatic acid in use, at a temperature sufficiently high for reaction to occur between the cyclic imide and the cellulosic material. Herein by the term "dispersion" is meant both a solution in a compatible organic liquid and also an aqueous emulsion.

Suitably the aliphatic acid can be monobasic or dibasic. The effective length of the hydrophobic moiety in the monobasic acids is simply the number of atoms in the longest straight chain, but for dibasic acids the effective length depends upon the relative position of the carboxylic acid groups in the molecule. Where both carboxylic acid groups are at or adjacent to one end of the molecule or the molecule is cruciform, the effective length of the straight chain of carbon atoms in the hydrophobic moiety is substantially similar to that of the monobasic acid having the same number of carbon atoms in the straight chain. Where the chain is terminated by a carboxylic group at each end, the molecule must assume a U-shape for the moiety distant from the surface of the cellulosic material to be hydrophobic and consequently the effective length of the straight chain is halved approximately, so that at least 12 methylene groups are required to provide an effective length of 6 carbon atoms in the straight chain. Thus, short chain carboxylic acid terminated dibasic acids such as adipic acid are not suitable, whereas relatively short chain monobasic acids having from 6 to 10 carbon atoms in a straight chain can lead to a reduction in the amount of cyclic imide required to achieve a desired level of sizing or waterproofing. Preferred aliphatic acids have an effective chain length of at least 12 carbon atoms. Particularly preferred monobasic acids contain from 14 to 26 carbon atoms in a straight chain, and more preferably are saturated. Examples of such particularly preferred acids are myristic, stearic, arachidic and behenic acids and ethylenically unsaturated analogues thereof, for example oleic or linoleic acid. Preferred dibasic acids include dimers of such unsaturated analogues. Any of the acids can have branch chains, e.g., methyl or ethyl provided that the main chain has at least the minimum number of carbon atoms.

In aqueous conditions the aliphatic acid can be produced in situ by hydrolysis of appropriate precursors such as the acid chloride or the anhydride.

We have found that use of a ratio of less than 10% by weight of the aliphatic acid described herein does not, in general lead to more effective use of the substituted cyclic imide and can, indeed result in less effective use. Herein, unless otherwise stated, percentage of the aliphatic acid is by weight based on the weight of substituted cyclic imide. We prefer the dispersions to contain at least 25% of any of the aliphatic acids, more desirably at least 50%, advantageously not more than 125% and more preferably not more than 100%.

Although the addition of the aliphatic acid is of value in the treatment of cellulosic materials with substituted cyclic imides in general, we have found that such addition is of particular and noticeable value when the cellulosic material is a bleached sulphate paper pulp or paper made therefrom. Hitherto we have found that in general larger amounts of reactive paper sizes such as substituted cyclic imides are needed to produce a given level of sizing, as measured by the Cobb test, when sizing sulphate pulps or paper than when sizing other pulps or paper, such as sulphate pulps or paper. By the use of at least certain of the aliphatic acids in proportion of 50 to 100% in conjunction with the substituted cyclic imide, the amount of substituted cyclic imide required to size sulphate pulp or paper can be reduced to approximately that required to size other pulps to a similar level of sizing using compositions not incorporating the aliphatic acids.

Suitable base dispersions, i.e., dispersions which are according to the present invention when an appropriate aliphatic acid is included, are dispersions containing a cyclic imide N-substituted by an hydrophobic acyl group described in said copending U.S. patent application, which description is specifically incorporated herein. As described in said copending U.S. patent application on pages 3 and 4, preferred cyclic imides are non-aromatic, and especially preferred cyclic imides contain a fused bicyclic system, the imide ring being five membered and linked to a non-aromatic six membered ring through two common carbon atoms. The improvements shown when the aliphatic acids are incorporated in dispersions containing N-stearoyl cyclohexene-1,2-dicarboximide are typical of the effect of incorporating the aliphatic acids in any of the base dispersions. Other components of the base dispersions are described on pages 5 and 6 of the said U.S. patent application. Thus, for example, the solutions can be in organic liquids free from hydroxyl and amino groups, such as dichloromethane and emulsions preferably contain retention aids preferably in a weight ratio to the imide of from 2:1 to 1:50 and optionally, emulsifying agents, suitably in a weight ratio to the imide of up to 1:1.

Methods of treating cellulosic materials can conveniently be effected using conventional equipment for sizing paper or pulp or for waterproofing textiles. Suitable methods, together with the range of cellulosic materials treatable, are described in the said copending U.S. patent application on pages 7 to 9, which description is specifically incorporated herein. Thus, for example, paper pulp can be contacted with sizing emulsion containing the substituted cyclic imide and the aliphatic acid at a pH of from 4 to 10, most suitable under alkaline condisitons. Dry sheets or rolls can be contacted in any conventional method used to impregnate fibrous materials. Although in some embodiments employing emulsions, preformed emulsion containing all the differently functioning compounds, i.e., size, retention aid, emulsifying agent and extender (aliphatic acid) are passed into the apparatus for treating the cellulosic material, in other embodiments solutions or emulsions of certain retention aids, such as polyamides or polyacrylamides, or the aliphatic acids can be passed into the apparatus separately from the emulsion containing the size thereby forming in situ a composition containing all the functioning components. After impregnation, the cellulosic material is conventionally dried at a temperature selected so as not to damage the material. The temperature is typically in excess of 50° C, often at 70° to 120° C for paper and at 100° to 150° for textile materials. Such temperatures enable reaction between the cyclic imide and the cellulosic material to occur in the period of drying which is generally within the range of from 0.5 to 5 minutes.

Certain embodiments according to the present invention are now described more fully by way of example. Experiments A and B of Examples 1, Example 2, Experiments A and B of Example 3, Experiments A, B, N, O, P, Q, R, S, T of Example 4 and Experiment 1 of Example 5 are present by way of comparison only and are indicated by *. All other experiments are according to the present invention.

EXAMPLE 1

In this example hand sheets preformed from a STORA 32 bleached sulphate pulp using a Mavis British Standard Pulp Evaluation Apparatus (sold by H. E. Messmer in London) were sized by contact with a solution in dichloromethane of 0.01% or 0.02% by weight of N-stearoyl cyclohexene-1,2-dicarboximide, (hereinafter referred to as SCD), and the appropriate quantity of aliphatic acid, stearic acid. Each hand sheet absorbed approximately its own weight of solution so that the concentration of solutes represented the final level of the solute in the paper expressed as % by weight of solute based on the dry weight of the fibre. Each hand sheet was allowed to lose solvent by evaporation at room temperature and was then heated to 110° C for 2.5 minutes. The effectiveness of sizing was then measured using a standard Cobb test. The values given in Table 1 below relate to the weight in grams of water absorbed per square meter of the paper after 60 seconds, the lower the figure the better the sizing.

TABLE 1

| Experiment No. | % Stearic Acid wt/wt on SCD | COBB values at % SCD of 0.01 | 0.02 |
|---|---|---|---|
| A* | 0 | 76 | 60 |
| B* | 5 | 72 | 66 |
| C | 10 | 69 | 45 |
| D | 25 | 69 | 39 |
| E | 50 | 69 | 26 |
| F | 75 | 53 | 23 |
| G | 100 | 56 | 21 |

TABLE 1-continued

| Experiment No. | % Stearic Acid wt/wt on SCD | COBB values at % SCD of 0.01 | 0.02 |
|---|---|---|---|
| H | 125 | 54 | 21 |

From Table 1 it can be seen that the presence of less than 10% of stearic acid led to little improvement or even to detriment in sizing the paper using SCD as reactive sizing agent. Furthermore it can be seen that in the range of addition of stearic acid of 0 to 125% based on the weight of SCD present, the improvement reaches a plateau generally in the region of about 50% to 100% addition, after which additional stearic acid results in no measurable advantage.

EXAMPLE 2

In this example hand sheets were prepared as in Example 1 and were treated in a similar manner to Example 1, except that the solution contained stearic acid only.

TABLE 2

| Experiment No. | % addition of stearic acid | COBB values |
|---|---|---|
| A* | 0.01 | 80 |
| B* | 0.03 | 75 |

From Table 2 it can be seen that by itself stearic acid is unable to size paper made from bleached sulphate pulp at level of addition of sizing agent of up to 0.03% by weight. Such figures are comparable with non-reactive sizes. Comparing Table 2 with Table 1 it can be seen that despite the lack of sizing ability of stearic acid interaction of it with SCD has led to significant improvements in sizing.

EXAMPLE 3

In this Example hand sheets prepared as in Example 1 except for the use of BERGVIC bleached sulphite pulp instead of STORA 32 bleached sulphate pulp were sized by the method described in Example 1. The solution contained SCD in a concentration of 0.01% by weight.

TABLE 3

| Experiment No. | % stearic acid wt/wt on SCD | COBB values |
|---|---|---|
| A* | 0 | 29 |
| B* | 5 | 32 |
| C | 10 | 31 |
| D | 25 | 25 |
| E | 50 | 22 |

From Table 3 it can be seen that even when the paper reached partial sizing using stearic acid-free solutions, significant improvement was obtained when solutions containing 25 to 50% of stearic acid were employed.

EXAMPLE 4

In this Example hand sheets prepared as in Example 1 were sized with a solution containing 0.02% by weight of SCD and 0.01% by weight of extender by the method described in Example 1.

TABLE 4

| Experiment No. | Extender | COBB value |
|---|---|---|
| A* | None | 60 |
| B* | Iso butyric acid | 57 |

TABLE 4-continued

| Experiment No. | Extender | COBB value |
|---|---|---|
| C | n- caproic acid | 47 |
| D | n- caprylic acid | 46 |
| E | n-capric acid | 52 |
| F | lauric acid | 37 |
| G | myristic acid | 25 |
| H | palmitic acid | 26 |
| I | mixture of palmitic and stearic acids (33% C16, 66% C18) | 24 |
| J | stearic acid | 21 |
| K | behinic behenic 19 | |
| L | dimer acid dibasic (C36) | 28 |
| M | oleic acid | 38 |
| N* | maleic acid | 68 |
| O* | phthalic acid | 68 |
| P* | adipic acid | 75 |
| Q* | succinic acid | 70 |
| R* | acetamide | 66 |
| S* | stearamide | 65 |
| T* | n- octadecene | 60 |

From Table 4 it can be seen that monobasic aliphatic acids containing at least 6 carbon atoms in a straight chain led to significant improvements in the sizing of the hand sheets, but that the aromatic acids and short chain dibasic aliphatic acids led to an impairment of sizing. Surprisingly, the long chain amide tested, stearamide, although a compound related to stearic acid, led to impaired sizing. Inclusion of waxy hydrocarbons led to substantially no change in the sizing performance of SCD.

EXAMPLE 5

In this Example STORA 32 bleached sulphate pulp was sized with emulsions of SCD. The emulsions were prepared by rapidly mixing SCD with an aqueous solution of cooked cationic starch in an emulsifier sold by Kinnematica GmbH under the Trade Mark POLYTRON PT 2000 at 90° C. The two emulsions contained respectively 1.1% by weight SCD, 0.55% cationic starch and 1.1% by weight SCD, 0.55% cationic starch, 1.1% stearic acid. The cooked cationic starch was sold by Laing National Ltd. under the Trade Mark CATO 8. The pulp was made into handsheets and sized with sufficient emulsion to result in the addition of the amount of SCD given in Table 5 using the Mavis pulp evaluation apparatus of Example 1, and 0.03% by weight of active ingredient based on the weight of the dry pulp of a retention aid comprising a 28% solution of a nitrogen containing cationic polyelectrolyte sold by Stockhausen under the Trade Mark of PRAESTOL K225FL, was added to the pulp at the disintegrator stage. The handsheets were then dried and heated to 110° C for 1.5 minutes, and Cobb Test performed to determine the effectiveness of the sizing.

Table 5

| Experiment | Emulsion | Cobb Values g/m² 60 sec. % SCD addition 0.1 | 0.125 | 0.15 |
|---|---|---|---|---|
| A* | SCD/CATO 8 | 75 | 67 | 64 |
| B | SCD/CATO 8/ stearic acid | 52 | 35 | 24 |

From Table 5 it can be seen that the presence of stearic acid markedly improved the sizing effectiveness of SCD from emulsion and that the improvement was especially pronounced at the level of addition of 0.15% of SCD. The results correlate well with those obtained from sizing from solution.

I claim:

1. In a composition for treating cellulosic materials comprising a dispersion of a cyclic imide substituted by an aliphatic hydrophobic group containing at least 12 carbon atoms and N- substituted by an acyl group as a reactive sizing or waterproofing agent the improvement comprising incorporating in said dispersion at least 10 to 125% by weight based on the cyclic imide of an aliphatic acid having an hydrophobic moiety comprising a straight chain having an effective length of at least 6 carbon atoms or a precursor of said aliphatic acid which generates said aliphatic acid in use.

2. A composition according to claim 1 wherein the aliphatic acid is a monobasic or dibasic acid, the straight chain of which has an effective length of at least 12 carbon atoms.

3. A composition according to claim 2 wherein the aliphatic acid is a monobasic acid containing from 14 to 26 carbon atoms.

4. A composition according to claim 2 wherein the aliphatic acid is a dibasic acid obtainable by dimerizing an ethylenically unsaturated monobasic acid containing from 14 to 26 carbon atoms.

5. A composition according to claim 1 wherein the dispersion contains from 25 to 125% by weight of the aliphatic acid based on the cyclic imide.

6. A composition according to claim 1 wherein the acyl group comprises an aliphatic hydrophobic group containing at least 11 carbon atoms linked to the carbonyl group of the acyl.

7. In a method of treating cellulosic materials comprising the step of contacting the cellulosic material with a dispersion of a cyclic imide substituted by an aliphatic hydrophobic group containing at least 12 carbon atoms and N- substituted by an acyl group, at a temperature sufficiently high for reaction to occur between the cyclic imide and the cellulosic material the improvement comprising the use of dispersion having incorporated therein at least 10 to 125% by weight based on the cyclic imide of an aliphatic acid having an hydrophobic moiety comprising a straight chain having an effective length of at least 6 carbon atoms or a precursor of said aliphatic acid which generates said aliphatic acid in use.

8. A method according to claim 7 wherein the cellulosic material is a bleached sulphate paper pulp.

* * * * *